US010149037B1

(12) United States Patent
Chen

(10) Patent No.: US 10,149,037 B1
(45) Date of Patent: Dec. 4, 2018

(54) EARBUDS WITH DETACHABLE EAR-WINGS

(71) Applicant: Scott Zhihao Chen, Irvine, CA (US)

(72) Inventor: Scott Zhihao Chen, Irvine, CA (US)

( * ) Notice: Subject to any disclaimer, the term of this patent is extended or adjusted under 35 U.S.C. 154(b) by 22 days.

(21) Appl. No.: 15/394,755

(22) Filed: Dec. 29, 2016

(51) Int. Cl.
*H04R 1/10* (2006.01)

(52) U.S. Cl.
CPC ..... *H04R 1/105* (2013.01); *H04R 1/1016* (2013.01)

(58) Field of Classification Search
CPC ..... H04M 1/05; H04R 1/105; H04R 1/1016; H04R 1/1041; H04R 1/1058; H04R 1/1091
See application file for complete search history.

(56) References Cited

U.S. PATENT DOCUMENTS 9,788,099 B2 * 10/2017 Mainini ..... H04R 1/105
2010/0027824 A1 * 2/2010 Atamaniuk ..... H04M 1/05 381/322
2010/0098285 A1 * 4/2010 Kusuda ..... H04M 1/05 381/375
2011/0255729 A1 * 10/2011 Tan ..... H04R 1/105 381/380
2014/0211959 A1 * 7/2014 Boyajian ..... H04R 1/1041 381/74
2016/0022498 A1 * 1/2016 Dittrich ..... A61F 11/08 128/864
2016/0066079 A1 * 3/2016 Kolton ..... H04R 1/1058 381/380
2017/0026738 A1 * 1/2017 Tang ..... H04R 1/1091
2017/0257714 A1 * 9/2017 Han ..... H04R 25/652

* cited by examiner

*Primary Examiner* — Fan Tsang
*Assistant Examiner* — Angelica M McKinney

(57) ABSTRACT

Disclosed are various designs of earbud structures including detachable and replaceable ear-wings and/or detachable and replaceable earplugs. In various embodiments, the body of a proposed earbud is a fixed component of the earbud which is configured to receive and accommodate different types of ear-wings and/or earplugs based on the user's need. Various embodiments of the proposed earbud designs provide an ear-wing structure that includes at least two components: a wing-shaped structure for fitting into the ear to achieve a desired stability, and a shell structure for attaching the wing-shaped structure onto the body of the earbud thereby attached the wing-shaped structure firmly onto the body of the earbud.

19 Claims, 5 Drawing Sheets

EARBUDS WITH DETACHABLE EAR-WINGS

TECHNICAL FIELD

The present disclosure relates to the field of wired and wireless headsets, and more specifically to the design of earbuds including a deformable and detachable ear-wing structure.

BACKGROUND

Wireless earbuds are set to gradually replace wired earbuds in the headsets market because getting rid of the wires allows for significantly improved applicability and user experience in all sorts of fitness and motion related conditions in addition to feeling of liberation from the tangled wires. When designing wireless earbuds, the lack of a mechanical connection between the two earpieces makes it necessary to include structures into the earbuds so that each earpiece can be fitted into user's ear with increased stability, especially in highly active use environments, such as sports and workouts, without causing discomfort.

SUMMARY

Disclosed are various designs of earbud structures including detachable and replaceable ear-wings and/or detachable and replaceable earplugs. In various embodiments, the body of a proposed earbud is a fixed component of the earbud which is configured to receive and accommodate different types of ear-wings and/or detachable and replaceable earplugs based on the user's need. Various embodiments of the proposed earbud designs provide an ear-wing structure that includes at least two components: a wing-shaped structure for fitting into the ear to achieve a desired stability, and a shell structure for attaching the wing-shaped structure onto the body of the earbud thereby attached the wing-shaped structure firmly onto the body of the earbud.

In one aspect, an earbud system is disclosed. This earbud system includes a body which includes a casing and a plurality of electronic components residing within the casing, for example, a speaker. The earbud system also includes a detachable ear-wing structure attached to the body. This detachable ear-wing structure further includes: an attachment structure configured to be attached to the body by enclosing at least a portion of the surface of the body, wherein the attachment structure includes at least one opening; and an ear-wing attached to the attachment structure and configured to be fitted inside a user's ear to affix and stabilize the body when the earbud is worn by the user.

In some embodiments, the casing includes a ledge surrounding the circumference of the casing. The rim of the at least one opening of the attachment structure is curled inward so that when the attachment structure is attached to the body, the rim of the at least one opening latches onto the ledge of the casing to achieve a secure attachment.

In some embodiments, the casing includes a top cover and a bottom cover, a first diameter of the top cover is slightly smaller than a second diameter of the bottom cover, so that when the top cover is assembled with the bottom cover to form the casing, the difference between the first and second diameters creates the ledge that surrounds the circumference of the casing.

In some embodiments, the width of the ledge is at least 0.5 millimeters.

In some embodiments, the casing includes a notch surrounding the circumference of the casing. The rim of the at least one opening of the attachment structure is curled inward so that when the attachment structure is attached to the body, the rim of the at least one opening engages with the notch of the casing to achieve a secure attachment.

In some embodiments, the attachment structure includes a shell structure, and when being attached to the body, the shell structure encloses at least one half of the surface of the body.

In some embodiments, the attachment structure includes a ring structure, and when being attached to the body, the ring structure wraps around the circumference of the body.

In some embodiments, the shape of the ear-wing is configured based at least on shapes of the outer ear substructures surrounded by the helix of the out ear. In some embodiments, these substructures include one or more of: a portion of the antihelix, the triangular fossa, the scapha, a cavity underneath the crus of helix, and the concha.

In some embodiments, the shape of the ear-wing follows the contour of the upper part of the antihelix.

In some embodiments, when the earbud is worn by the user, a surface of the ear-wing makes contact with one or more of: the upper part of the antihelix, the triangular fossa, and the concha.

In some embodiments, when the earbud is worn by the user, the tip portion of the ear-wing is positioned within a cavity underneath the crus of helix.

In some embodiments, when the earbud is worn by the user, the ear-wing is positioned within the concha.

In some embodiments, the ear-wing is made of an elastic and deformable material. Moreover, the ear-wing is allowed to bend both downward and upward from a neutral position when being fitted into a human ear.

In some embodiments, the earbud system further includes a set of detachable ear-wing structures. The set of detachable ear-wing structures includes a common attachment structure configured to be attached to the body and a set of ear-wings configured to have a plurality of sizes and shapes. The body of the earbud system is configured to be assembled with one of the set of detachable ear-wing structures to form a customized earbud.

In some embodiments, the earbud system is either a wired earbud system or a wireless earbud system.

In another aspect, an earbud system is disclosed. This earbud system includes a body which includes a casing and a plurality of electronic components residing within the casing. The earbud system also includes a detachable ear-wing structure attached to the body. This detachable ear-wing structure further includes: an attachment structure configured to be attached to the body by enclosing at least a portion of the surface of the body, wherein the attachment structure includes at least one opening; and an ear-wing attached to the attachment structure and configured to be fitted inside a user's ear to affix and stabilize the body when the earbud is worn by the user. The earbud system additionally includes an earplug attached to the body and configured to be positioned in the canal of the user's ear when the earbud is worn by the user.

In some embodiments, the body further includes a connector for attaching the earplug, and the earplug is detachable from the connector and the body.

In some embodiments, the attachment structure includes a hole configured to allow the connector to pass through.

In some embodiments, the attachment structure includes a connector guard structure around the hole to protect the connector.

In some embodiments, the earbud system further includes a set of detachable earplugs of different sizes, and the connector is configured to attach one of the set of detachable earplugs to the body to form a customized earbud based on the size of the user's ear.

In yet another aspect, an earbud system is disclosed. This earbud system includes a body which includes a casing and a plurality of electronic components residing within the casing. The earbud system also includes an ear-wing structure attached to the body. This ear-wing structure further includes: an attachment structure configured to be attached to the body by enclosing at least a portion of the surface of the body, wherein the attachment structure includes at least one opening; and an ear-wing attached to the attachment structure and configured to be fitted inside a user's ear to affix and stabilize the body when the earbud is worn by the user. The earbud system additionally includes a detachable earplug attached to the body and configured to be positioned in the canal of the user's ear when the earbud is worn by the user.

DETAILED DESCRIPTION

Figure 1A:
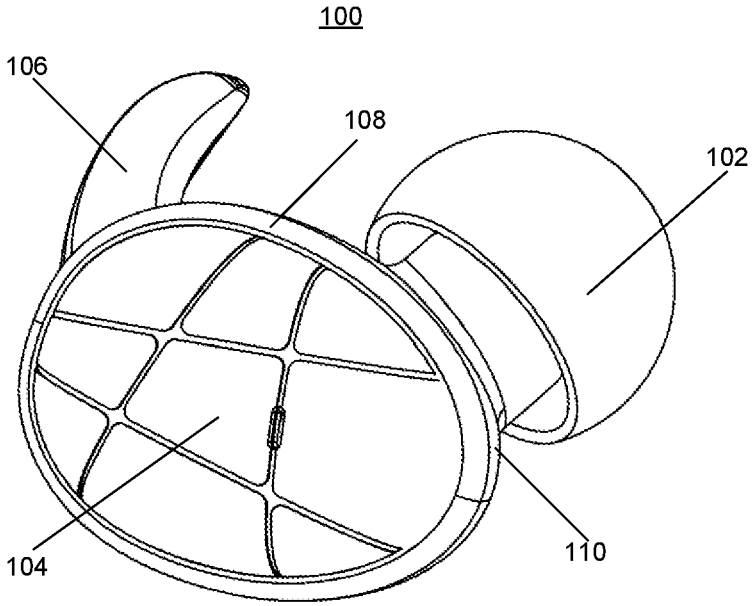
FIG. 1A shows an exemplary earbud comprising an ear-wing structure in accordance with some embodiments described herein.

Disclosed are various designs of earbud structures including detachable and replaceable ear-wings. In various embodiments, the body of a proposed earbud is a fixed component of the earbud which is configured to receive and accommodate different types of ear-wings based on the user's need. Various embodiments of the proposed earbud designs provide an ear-wing structure that includes at least two components: a wing-shaped structure for fitting into the ear to achieve a desired stability and a shell structure for attaching the wing-shaped structure onto the body of the earbud thereby attached the wing-shaped structure firmly onto the body of the earbud.

In one aspect, an earbud system is disclosed. This earbud system includes a body which includes a casing and a plurality of electronic components residing within the casing, for example, a speaker. The earbud system also includes a detachable ear-wing structure attached to the body. This detachable ear-wing structure further includes: an attachment structure configured to be attached to the body by enclosing at least a portion of the surface of the body, wherein the attachment structure includes at least one opening; and an ear-wing attached to the attachment structure and configured to be fitted inside a user's ear to affix and stabilize the body when the earbud is worn by the user.

In another aspect, an earbud system is disclosed. This earbud system includes a body which includes a casing and a plurality of electronic components residing within the casing. The earbud system also includes a detachable ear-wing structure attached to the body. This detachable ear-wing structure further includes: an attachment structure configured to be attached to the body by enclosing at least a portion of the surface of the body, wherein the attachment structure includes at least one opening; and an ear-wing attached to the attachment structure and configured to be fitted inside a user's ear to affix and stabilize the body when the earbud is worn by the user. The earbud system additionally includes an earplug attached to the body and configured to be positioned in the canal of the user's ear when the earbud is worn by the user.

In yet another aspect, an earbud system is disclosed. This earbud system includes a body which includes a casing and a plurality of electronic components residing within the casing. The earbud system also includes an ear-wing structure attached to the body. This ear-wing structure further includes: an attachment structure configured to be attached to the body by enclosing at least a portion of the surface of the body, wherein the attachment structure includes at least one opening; and an ear-wing attached to the attachment structure and configured to be fitted inside a user's ear to affix and stabilize the body when the earbud is worn by the user. The earbud system additionally includes a detachable earplug attached to the body and configured to be positioned in the canal of the user's ear when the earbud is worn by the user.

Presently, the wireless earbuds which use an ear-wing structure are constructed such that the ear-wing structure and the rest of the earbud body are integrated in such a way that they are inseparable. In these designs, the ear-wing of an earbud cannot be changed or replaced. The disclosed embodiments of the earbuds provide earbuds structures with detachable ear-wings, so that the ear-wings can be changed quickly and easily based on the different sizes and shapes of the ears, different use environment (e.g., office, leisure, and sports), and other specific needs of the consumers. In these embodiments, the body of the earbuds is the fixed component of the earbuds which is configured to receive and accommodate different types of ear-wings based on the user's need.

Some embodiments of the proposed earbuds designs provide an ear-wing structure that includes at least two components: a wing-shaped structure for fitting into the ear to achieve a desired stability and a shell structure for attaching the wing-shaped structure onto the body of the earbud thereby attached the wing-shaped structure firmly onto the body of the earbud. In some embodiments, the attachment between the shell structure and the body of the earbud includes enclosing a portion of the earbud body using the shell structure with firm contact and sufficient tension between the shell structure and the portion of the earbud body. In some embodiments, the attachment between the shell structure and the body of the earbud includes a catch mechanism to fasten the shell structure onto the body of earbud. For example, the body of the earbud can include a "ledge" while the shell structure can include a "lip" so that when the shell structure is pushed onto the body of the earbud, the lip of the shell structure snap-fits around the ledge of the earbud body to achieve a securely attachment. In some embodiments, the shell structure can be replaced with a ring structure.

FIG. 1A shows an exemplary earbud 100 comprising an ear-wing structure in accordance with some embodiments described herein. As can be in seen in FIG. 1A, earbud 100 includes an ear-plug 102. When worn by a user, ear-plug 102 is positioned into the concha of the ear next to the ear canal. Earbud 100 also includes a body 104 which includes a casing (partly shown) and various electronic components (not visible) of an earbud residing within the casing. The electronic components within body 104 can include, but are not limited to: an antenna, a PCB assembled with various circuits, and a battery.

Earbud 100 additionally includes an ear-wing 106 which is configured with a narrow and curved profile which tapers into a tip. In some embodiments, the shape of ear-wing 106 is configured ergonomically based on the anatomy of human ear. For example, the shape of ear-wing 106 can be configured based on the outer ear substructures surrounded by the helix, which include, but are not limited to, a portion of the antihelix, triangular fossa (a small depression between the upper parts of the antihelix), scapha (a curved depression between the helix and the antihelix), and concha. In some embodiments, the ergonomic shape of ear-wing 106 also takes into accounts the cavity underneath the crus of helix. In some embodiments, when worn by a user, ear-wing 106 can be positioned to follow the contour of the upper part of the antihelix. In some embodiments, when placed in the ear, the surface of ear-wing 106 makes contacts with one or more surfaces of the upper part of the antihelix, the triangular fossa, and possibly the bottom edge of the upper helix. In some embodiments, to allow earbud 100 to be stably and comfortably attached to the ear, the tip of ear-wing 106 can be positioned at the inner portion of the triangular fossa which is underneath the crus of helix. In other embodiments, the entire ear-wing 106 can be positioned within the concha of the ear.

In some embodiments, ear-wing 106 is made of a material which is elastic, deformable, and soft to the skin of the ear. For example, ear-wing 106 can be made of silicone. The elasticity of the material can allow ear-wing 106 to deform in some degree to better accommodate variable ear structures of different users. For example, ear-wing 106 is allowed to bend both downward and upward from its neutral position when being fitted into a human ear. In some embodiments, ear-wing 106 is made of a memory material.

Note that ear-wing 106 is attached onto a shell structure 108 which encloses around a portion of body 104, whereby attaching ear-wing 106 to body 104. FIG. 1A shows that the circumference of shell structure 108 wraps around body 104 but does not complete enclose body 104. In some embodiments, shell structure 108 is configured to enclose at least one half of body 104. FIG. 1A also shows that the rim of shell structure 108 is curled inward (see also FIG. 1B). In some embodiments, body 104 includes a narrow ledge (not shown) to allow the rim of shell structure 108 to be latched onto, thereby further preventing shell structure 108 from slipping off from body 104 after they are assembled. FIG. 1A also shows a stripe 110 of shell structure 108 on the right side where earplug 102 meets body 104 through the surface of shell structure 108. The main portion of shell structure 108 and the portion of body 104 which is enclosed by shell structure 108 are not readily visible in FIG. 1A due to the specific viewing angle but will be made more visible in FIGS. 1B and 1C showing different viewing angles of ear-bud 100.

In some embodiments, ear-wing 106 and shell structure 108 are configured as a single structure such that they are permanently connected. For example, ear-wing 106 and shell structure 108 can be formed of the same material, such as silicone, from the same molding process. In some embodiments, the attachment mechanism between shell structure 108 and body 104 is mechanical and tensional but is not permanent. This attachment mechanism allows for detaching shell structure 108 and ear-wing 106 from earbud body 104 as needed and attaching a different pair of shell structure and ear-wing with body 104 in place of the existing shell structure 108 and ear-wing 106 to form a different earbud structure. This allows a user to choose different types of ear-wings for different use environments, thereby enhancing applicability and user experience. Making ear-wing detachable and replaceable also allows a common earbud body 104 to be configurable to different users based on the outer ear anatomy of each specific user.

Figure 1B:
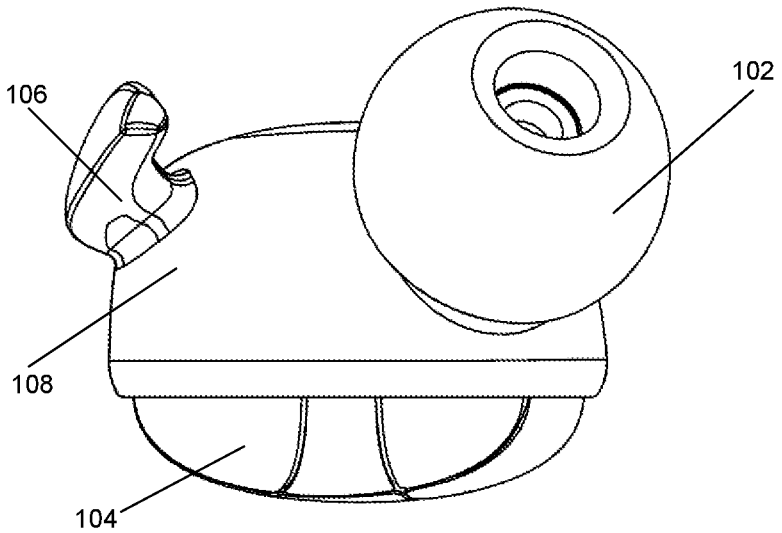
FIG. 1B shows the exemplary earbud from another viewing angle in accordance with some embodiments described herein.

FIG. 1B shows the exemplary earbud 100 from another viewing angle in accordance with some embodiments described herein. As can be seen in FIG. 1B, shell structure 108 includes a hemispherical portion which is configured to enclose around a portion of body 104. Ear-wing 106 is attached to the surface of shell structure 108 on the left while earplug 102 is attached to body 104 though the surface of shell structure 108. In some embodiment, shell structure 108 includes a hole or an opening to allow the connection between earplug 102 and body 104 though a connector. Note that the bottom portion of body 104 shown in FIG. 1B is not enclosed by shell structure 108. This portion of body 104 is facing outwards when earbud 100 is worn by a user. In some embodiments, this portion of body 104 is configured with patterns and/or colors to achieve desirable visual appearances.

Figure 1C:
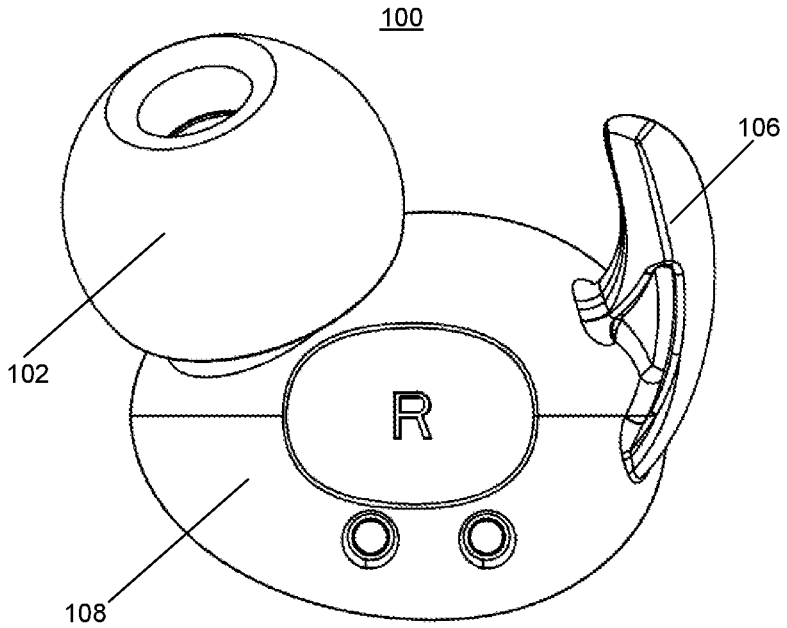
FIG. 1C shows the exemplary earbud from yet another viewing angle in accordance with some embodiments described herein.

FIG. 1C shows the exemplary earbud 100 from yet another viewing angle in accordance with some embodiments described herein. From this viewing angle, outer surface of shell structure 108 is in a full frontal view which may include functional and/or decorative patterns or markings, e.g., a letter indicating the left or the right earpiece. The curved ear-wing 106 is shown to be attached at its root to the surface of shell structure 108 while earplug 102 is attached to body 104 though the surface of shell structure 108. However in this view, body 104 is behind shell structure 108 and not readily visible.

Figure 1D:
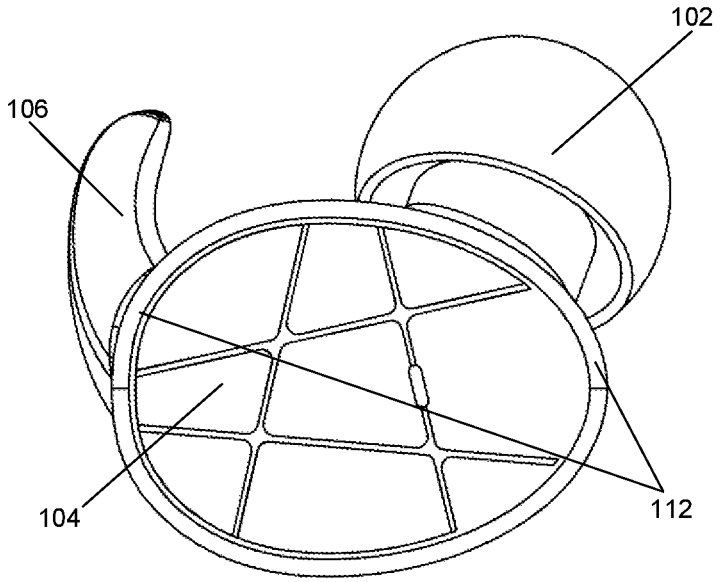
FIG. 1D shows the exemplary earbud from yet another viewing angle in accordance with some embodiments described herein.

FIG. 1D shows the exemplary earbud 100 from yet another viewing angle in accordance with some embodiments described herein. As can be observed, FIG. 1D is obtained by rotating FIG. 1C around a vertical axis by 180 degrees. From this viewing angle, the surface of body 104 not enclosed by shell structure 108 is in a full frontal view while shell structure 108 is largely behind body 104 with only the curled rim 112 of shell structure 108 being visible.

Figure 2:
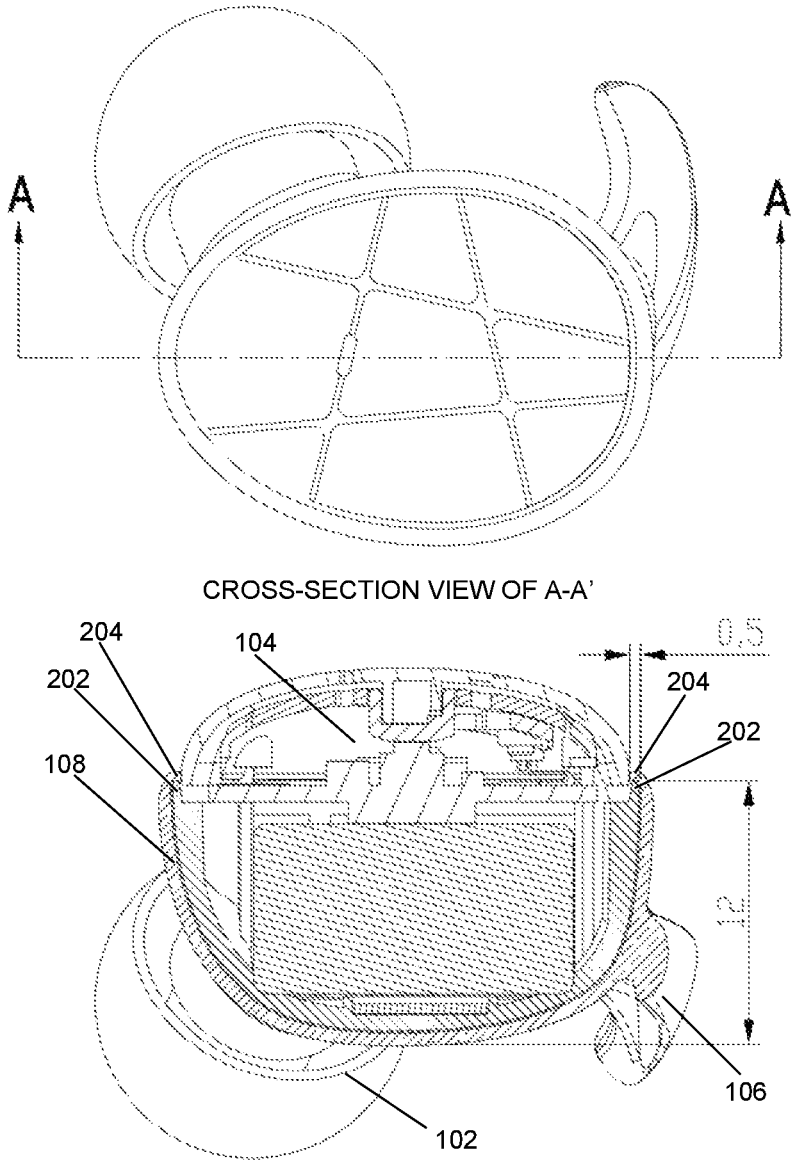
FIG. 2 shows a cross-sectional view of the exemplary earbud through a plane A-A' bisecting the body of the earbud in accordance with some embodiments described herein.

FIG. 2 shows a cross-sectional view of earbud 100 through a plane A-A' bisecting body 104 in accordance with some embodiments described herein. As can be seen, FIG. 2 exposes various components inside body 104. FIG. 2 also shows some exemplary dimensions including the height of shell structure 108, which in this example is approximately 12 mm. Note that shell structure 108 enclosed more than half of the surface area of body 104. In the embodiment of FIG. 2, body 104 is shown to include a ledge 202 around the circumference of body 104, while shell structure 108 includes a curled rim 204. As can be seen, shell structure 108 can be snap-fitted with body 104 when the curled rim 204 is latched or hooked onto ledge 202. In some embodiments, the width of ledge 202 is at least 0.5 mm to achieve sufficient latching force between body 104 and shell structure 108. Note that while FIG. 2 shows a latching mechanism is used to securely attach ear-wing 106 to body 104, other embodiments of earbud 100 may not require such a latch mechanism if the contact between shell structure 108 and body 104 creates sufficient friction and tension to prevent shell structure 108 from slipping off the surface of body 104.

Figure 3:
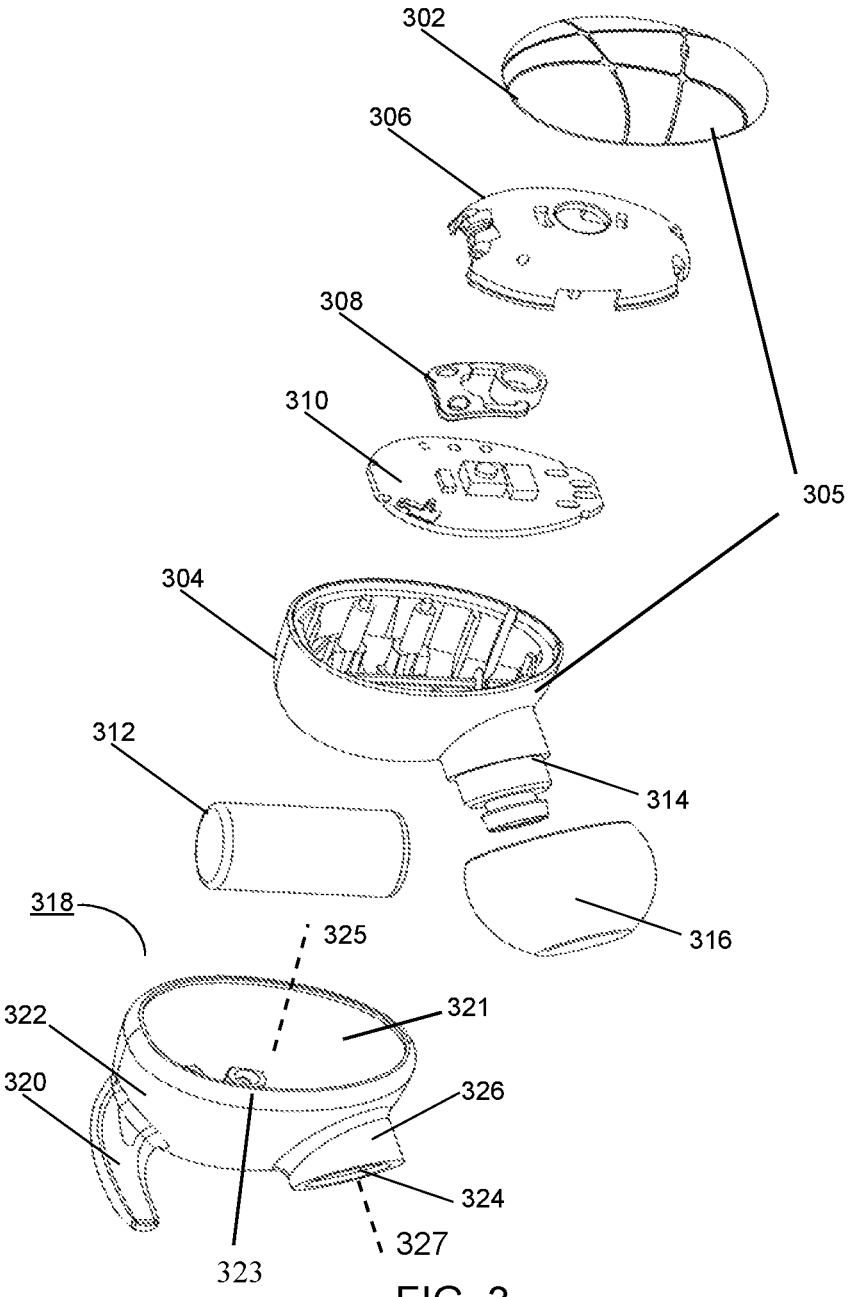
FIG. 3 shows an exploded view of the exemplary earbud in accordance with some embodiments described herein.

FIG. 3 shows an exploded view of the exemplary earbud 100 in accordance with some embodiments described herein. As can be seen in FIG. 3, earbud 100 includes a top cover 302 and a bottom cover 304. When assembled, top cover 302 and bottom cover 304 form a sealed protective casing 305, i.e., body 104 of earbud 100 as described above. Within this casing, there can include a number of electronic components and mechanical structures. As shown in FIG. 3, there can be an antenna assembly 306 (e.g., if earbud 100 is configured as a wireless or Bluetooth device), a spring-arm support 308, a printed circuit board assembly (PCBA) 310 which contains various circuits including, e.g., a processor, and a battery 312.

In the embodiment shown, bottom cover 304 also includes a connector 314 for connecting with a detachable earplug 316. In some embodiments, connector 314 can be used to attach detachable earplug 316 of different designs. For example, based on the type of human ears, a serial of detachable earplugs 316 of different sizes can be provided. While the earbud body 104 may be fixed, a user can choose a particular earplug 316 having desirable size for better fitting with the user's ear. In one embodiment, four sizes of earplug 316, i.e., large, medium, small, and extra-small, are provided as available choices for earplug 316. In some embodiments, the speaker of earbud 100 can be located inside connector 314.

In FIG. 3, ear-wing structure 318 is shown as an integrated structure which comprises both an ear-wing 320 and the shell structure 322. To accommodate connector 314 on the bottom cover 304, shell structure 322 also includes a first opening 321 along a first axis 325 and a second opening 324 along a second axis 327 different from first axis 325 so that when ear-wing structure 318 is assembled with the bottom cover 304, connector 314 on the bottom cover 304 can pass through the opening 324 to be engaged with earplug 316. In some embodiments, second opening 324 can be configured with a ring guard 326 which provides a degree of protection for connector 314 that is fitted through opening 324.

In some embodiments, the diameter of top cover 302 is configured to be slightly smaller than the diameter of bottom cover 304. Moreover, bottom cover 304 can include a recess to receive the top cover 302. Now referring to FIG. 2, note that in these embodiments, when top cover 302 and bottom cover 304 are assembled, top cover 302 drops below the top surface of the bottom cover 304 and rests on the recess of bottom cover 304. As a result, the difference in the diameters creates the above-described narrow ledge which fully surrounds top cover 302. In the example of FIG. 2, this ledge is shown to have a width of approximately 0.5 mm. As described above, this ledge structure in the assembled earbud body allows the top edge of shell structure 322 to latch onto thereby achieving a highly stable attachment. While the above embodiments describe the ledge being formed as a result of the difference in the sizes of top cover 302 and bottom cover 304, other embodiments can form a ledge directly on the surface of either top cover 302 or bottom cover 304. In these embodiments, the size of top cover 302 and bottom cover 304 can be substantially identical. Moreover, instead of using a ledge structure to secure the attachment between shell structure 322 and the earbud body, some embodiments can form a notch around the earbud body, either on the top cover 302 or the bottom cover 304, so that a curled rim 323 of shell structure 322 can engage with the notch when assembled with the earbud body to achieve a secure attachment.

Figure 4:
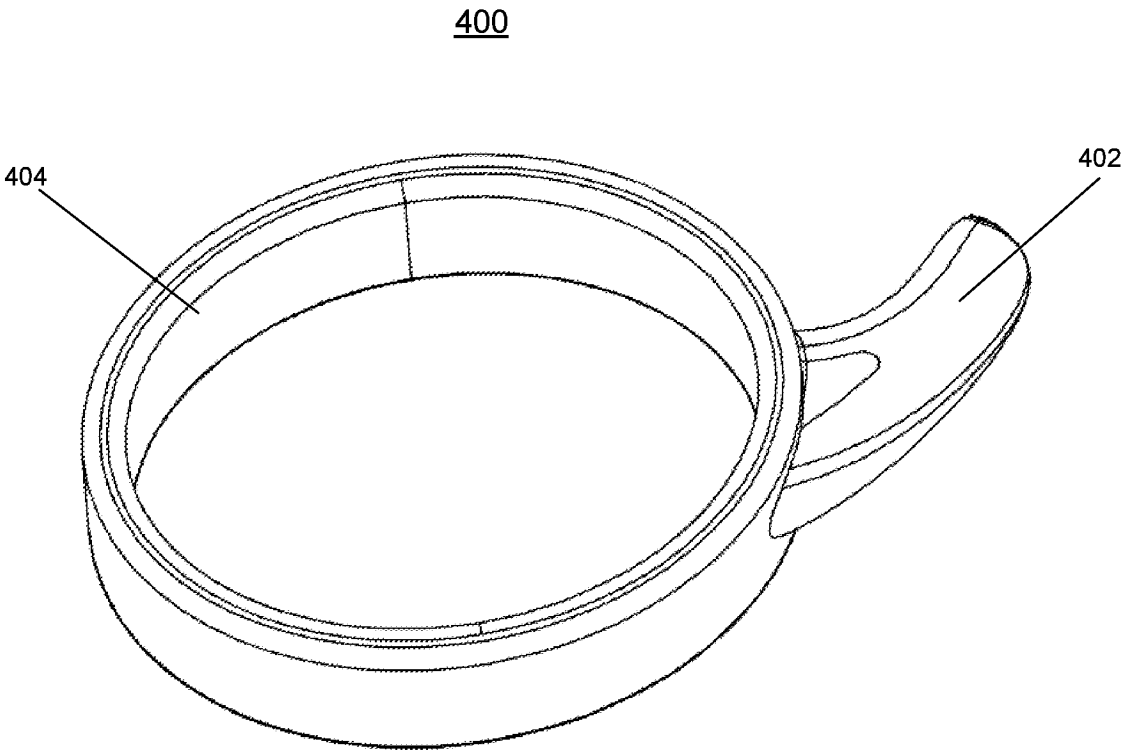
FIG. 4 shows an exemplary ear-wing structure for a proposed earbud in accordance with some embodiments described herein.

FIG. 4 shows an exemplary ear-wing structure 400 for a proposed earbud in accordance with some embodiments described herein. In the design shown in FIG. 4, ear-wing structure 400 include an ear-wing 402 attached to a ring structure 404. Compared to ear-wing structures of FIGS. 1A-1D, ring structure 404, which is open on both the top side and the bottom side, has replaced the shell structure 108, which is open on one side and closed on the other side. In this embodiment, ear-wing structure 400 can be assembled with an earbud body by simply wrapping ring structure 404 around the circumference of the earbud body (not shown). It can also be observed that if the ear-wing structure 400 needs to be replaced, ear-wing structure 400 can also be easily removed from the ear-bud body. It is also observed that ring structure 404 typically has a smaller surface area compared to shell structure 108.

A person having ordinary skill in the art can appreciate that in addition to exemplary ear-wing structures that use a shell structure 108 as in earbud 100 or ring structure 404 as in ear-wing structure 400, other designs of ear-wing structures can be provided by replacing the shell structure 108 or the ring structure 404 with a different structure which is configured to both provide a surface for attaching the ear-wing and a mechanism for attaching the ear-wing structure securely with an earbud body.

Note that while the above described embodiments of the proposed earbuds include both detachable ear-wings and detachable earplugs, other embodiments of the propose earbuds can include the disclosed detachable ear-wings without detachable earplugs. For example, in some embodiments, the body of the earbud can be configured to also serve the function of the earplug, thereby eliminating the need to have a separate earplug and having a separate connector on the body of the earbud. In these embodiments, the detachable ear-wing structure also does not need to have a separate opening to accommodate the earplug connector. The disclosed earbud designs having a detachable ear-wing and/or a detachable earplug can be used in both wired earbud systems and wireless earbud systems including Bluetooth earbud systems.

While this patent document contains many specifics, these should not be construed as limitations on the scope of any invention or of what may be claimed, but rather as descriptions of features that may be specific to particular embodiments of particular inventions. Certain features that are described in this patent document and attached appendix in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document and attached appendix should not be understood as requiring such separation in all embodiments.

Only a few implementations and examples are described and other implementations, enhancements and variations can be made based on what is described and illustrated in this patent document.

What is claimed is:

1. An earbud system, comprising:

a body which includes a casing and a plurality of electronic components residing within the casing, wherein the casing includes a top cover and a bottom cover having a connector and further includes a ledge surrounding the circumference of the casing; and an ear-wing structure attached to the body and is detachable from the body, wherein the ear wing structure includes:

a shell structure configured to be attached to the body by enclosing at least a portion of the surface of the body, wherein the shell structure includes a first opening along a first axis and a second opening along a second axis different from the first axis; and wherein the first opening comprises a curled rim to latch onto the ledge of the casing to achieve a secure attachment and the second opening is configured with a ring guard that is extruded from the shell structure along the second axis and provides protection for the connector; and an ear-wing attached to the shell structure and configured to be fitted inside an ear of a user to affix and stabilize the body when the earbud is worn by the user, wherein the connector of the bottom cover of the casing passes through the second opening to be engaged with an earplug so that the second opening is located between the connector and the earplug.

2. The earbud system of claim 1, wherein the curled rim of the first opening of the shell structure is curled inward so that when the shell structure is attached to the body.

3. The earbud system of claim 2, wherein a first diameter of the top cover is smaller than a second diameter of the bottom cover, so that when the top cover is assembled with the bottom cover to form the casing, the difference between the first and second diameters creates the ledge that surrounds the circumference of the casing.

4. The earbud system of claim 3, wherein the ledge has a width and the width is at least 0.5 millimeters.

5. The earbud system of claim 1, wherein the casing includes a notch surrounding the circumference of the casing, and wherein the curled rim of the first opening of the shell structure is curled inward so that when the shell structure is attached to the body, the curled rim of the first opening engages with the notch of the casing to achieve a secure attachment.

6. The earbud system of claim 1, wherein the shell structure encloses at least one half of the surface of the body.

7. The earbud system of claim 1, wherein the shell structure includes a ring structure, wherein when being attached to the body, the ring structure wraps around the circumference of the body.

8. The earbud system of claim 1, wherein the ear-wing has a shape configured based at least on shapes of outer ear substructures surrounded by an helix of the outer ear.

9. The earbud system of claim 8, wherein the substructures include one or more of: a portion of an antihelix, a triangular fossa, a scapha, a cavity underneath a crus of the helix, and a concha.

10. The earbud system of claim 8, wherein the shape of the ear-wing follows a contour of an upper part of the antihelix.

11. The earbud system of claim 10, wherein when the earbud is worn by the user, a surface of the ear-wing makes contact with one or more of: the upper part of the antihelix, the triangular fossa, and the concha.

12. The earbud system of claim 1, wherein when the earbud is worn by the user, a tip portion of the ear-wing is positioned within a cavity underneath a crus of a helix.

13. The earbud system of claim 1, wherein when the earbud is worn by the user, the ear-wing is positioned within a concha.

14. The earbud system of claim 1, wherein the ear-wing is made of an elastic and deformable material.

15. The earbud system of claim 1, wherein the ear-wing is allowed to bend both downward and upward from a neutral position when being fitted into a human ear.

16. The earbud system of claim 1, wherein the earbud system is either a wired earbud system or a wireless earbud system.

17. An earbud system, comprising:

a body which includes a casing and a plurality of electronic components residing within the casing, wherein the casing includes a top cover and a bottom cover having a connector and further includes a ledge surrounding the circumference of the casing;

an ear-wing structure attached to the body, wherein the ear-wing structure is detachable from the body and includes:

a shell structure configured to be attached to the body by enclosing at least a portion of the surface of the body, wherein the shell structure includes a first opening along a first axis and a second opening along a second axis different from the first axis; and wherein the first opening comprises a curled rim to latch onto the ledge of the casing to achieve a secure attachment and the second opening is configured with a ring guard that is extruded from the shell structure along the second axis and provides protection for the connector; and an ear-wing attached to the shell structure and configured to be fitted inside an ear of a user to affix and stabilize the body when the earbud is worn by the user; and an earplug attached to the body and configured to be positioned in a canal of the ear when the earbud is worn by the user, wherein the connector of the bottom cover of the casing passes through the second opening to be engaged with the earplug so that the second opening is located between the connector and the earplug, and the shell.

18. The earbud system of claim 17, wherein the connector is for attaching the earplug, wherein the earplug is detachable from the connector and the body.

19. The earbud system of claim 18, wherein the second opening is configured to allow the connector to pass through.

* * * * *